United States Patent [19]

Murakami et al.

[11] Patent Number: 4,868,556

[45] Date of Patent: Sep. 19, 1989

[54] CATHODE RAY TUBE CONTROLLER

[75] Inventors: Jyoji Murakami; Katsumi Hashimoto, both of Kawasaki; Junya Tempaku, Yokosuka, all of Japan

[73] Assignees: Fujitsu Limited; Fujitsu Microcomputer Systems Limited, both of Kawasaki, Japan

[21] Appl. No.: 77,297

[22] Filed: Jul. 24, 1987

[30] Foreign Application Priority Data

| | | | |
|---|---|---|---|
| Jul. 25, 1986 | [JP] | Japan | 61-174853 |
| Jul. 25, 1986 | [JP] | Japan | 61-174852 |
| Aug. 21, 1986 | [JP] | Japan | 61-195924 |

[51] Int. Cl.[4] ..... G09G 1/00

[52] U.S. Cl. ..... 340/799; 340/750

[58] Field of Search ..... 340/799, 798, 750, 703, 340/748, 749; 364/521

[56] References Cited

U.S. PATENT DOCUMENTS

| | | | |
|---|---|---|---|
| 4,104,624 | 8/1978 | Hamuda | 340/799 |
| 4,109,244 | 8/1978 | Barnes et al. | 340/750 |
| 4,556,879 | 12/1985 | Tunaka | 340/750 |
| 4,604,615 | 8/1986 | Funahashi | 340/750 |
| 4,646,077 | 2/1987 | Culley | 340/799 |

*Primary Examiner*—Gerald Brigance
*Assistant Examiner*—Alvin Oberley
*Attorney, Agent, or Firm*—Staas & Halsey

[57] ABSTRACT

A cathode ray tube controller holds a write-in address and displaying image data or a read-out address from a central processing unit. The cathode ray tube controller makes access to a memory by a write-in or read-out address from the central processing unit during a period in which the displaying image data in a horizontal scanning period are not read out from the memory, so that the read or write operation with respect to the memory can be carried out during the horizontal scanning period.

2 Claims, 6 Drawing Sheets

21
39
CLK
40
CLK GENE
41
H. COUNT
42
H. CONTL
43
V. COUNT
44
V. CONTL
45
SYNC GENE
47a
SYNC
47b
46
OP & CONTL
50
INTERFACE
51
52
DATA BUS
53
DATA
54
ADDR REG
55
ADR
56
INT REG
57
TRANS TABLE
58
LUT
59a
LUT
59b
LUT
60
MEM ACCESS TIM CONTL
61
R/W CONTL
62
ADDR COUNT & LIMIT
63
TRANS CONTL
64
W̄, R̄ (or R/W̄)
65
ADDR CONTL
66
ADR
67
R/W SW
68
DATA
69
BUFF
69a
PAT BUFF
69b
COL BUFF
69c
ATT BUFF
70
SELECT
71
D/A CONV
72
A.Vcc
73
R.G.B.
R/W
CHIP SELECT
DATA
ADR

CATHODE RAY TUBE CONTROLLER

BACKGROUND OF THE INVENTION

The present invention generally relates to cathode ray tube controllers, and more particularly to a cathode ray tube controller which successively reads out from a memory image data amounting to one picture, and converts the image date into a video signal which is supplied to a cathode ray tube so as to display the picture on the cathode ray tube.

Generally, in an image display system, image data amounting to one picture is stored in a random access memory (RAM), and the stored image data are successively read out from the RAM depending on horizontal and vertical scans of the cathode ray tube (CRT). The image data read out from the RAM are converted into a video signal which is supplied to the CRT so as to display the picture thereon.

In such an image display system, a CRT controller is provided to control the write and read operations of the RAM. The CRT controller carries out a control so that the image data for display (hereinafter simply referred to as the displaying image data) are read out from the RAM and other processes such as rewriting of data in the RAM are carried out by a central processing unit (CPU). As a result, it is possible to rewrite the displaying image data at a high speed.

In an example of the conventional image display system, a CPU reads and writes image data from and into a RAM by making access to the RAM at an address which is supplied from the CPU to the RAM via a multiplexer. A CRT controller makes access to the RAM so as to read out displaying image data from the RAM, and the read out image data are supplied to a video signal generating circuit. The multiplexer carries out an address multiplexing so that only one of the CPU and the CRT controller makes access to the RAM at one time. The video signal generating circuit converts the read out image data into primary color signals of red, green and blue responsive to a synchronizing signal from the CRT controller. The primary color signals are supplied to a CRT and a picture described by the read out image data is displayed on the CRT.

Even within a horizontal scanning period, there exists a non-access interval in which the CRT controller does not make access to the RAM, but this non-access interval is considerably short compared to a horizontal scanning period. For this reason, even if a control signal indicating a start of this non-access interval is supplied from the CRT controller to the CPU, it takes time for the CPU to actually receive the control signal and switch the multiplexer so as to make access to the RAM. Therefore, it is impossible to make access to the RAM within the non-access interval.

Accordingly, even when an access request for making access to the RAM is generated in the CPU, the CPU must wait until the horizontal or vertical blanking period is reached before the access to the RAM may be made. Thus, there are problems in that the processing efficiency of the CPU is poor and the access speed to the RAM is slow.

On the other hand, in a character and pattern telephone access information network (CAPTAIN) system, for example, the image data are transmitted to the CPU irrespective of the scanning period and the blanking period. Hence, even within a horizontal scanning period, the CPU must make access to the RAM and carry out operations such as writing the image data into the RAM. As a result, there is a problem in that the conventional CRT controller cannot cope with such operations.

Furthermore, there are cases where the color of the displayed picture is changed into a predetermined color, such as the case where the displayed picture is changed to an all white picture. In this case, the CPU makes access to the RAM and initializes the RAM by rewriting all of the image data into white image data. The RAM is normally initialized within the vertical blanking period, but since the CPU rewrites all of the image data in the RAM during this initializing period, the CPU cannot carry out other processes during this initializing period. Therefore, there is a problem in that the processing efficiency of the CPU is poor.

SUMMARY OF THE INVENTION

Accordingly, it is a general object of the present invention to provide a novel and useful cathode ray tube controller in which the problems described heretofore are eliminated.

Another and more specific object of the present invention is to provide a cathode ray tube controller which holds a write-in address and displaying image data or a read-out address from a central processing unit, and which makes access to a memory by a write-in or read-out address from the central processing unit during a period in which the displaying image data in a horizontal scanning period are not read out from the memory. According to the cathode ray tube controller of the present invention, the read or write operation with respect to the memory can be carried out during the horizontal scanning period. Hence, it is possible to improve the processing efficiency of the central processing unit, and the memory access by the central processing unit can be carried out at a high speed.

Still another object of the present invention is to provide a cathode ray tube controller in which at least one of color data and attribute data are read out during the horizontal blanking period and used for the display. According to the cathode ray tube controller of the present invention, it is possible to write image data into the memory from the central processing unit within the horizontal scanning period. Thus, it is possible to apply the present invention to an image display system in which the image data are transmitted within the horizontal scanning period and to improve the processing efficiency of the central processing unit.

A further object of the present invention is to provide a cathode ray tube controller in which initializing image data from the central processing unit are written into the memory and also converted into a video signal and displayed on a cathode ray tube when initializing the memory. According to the cathode ray tube controller of the present invention, the central processing unit can carry out other processes while the initializing operation is carried out, and the processing efficiency of the central processing unit is improved.

Other objects and further features of the present invention will be apparent from the following detailed description when read in conjunction with the accompanying drawings.

DESCRIPTION OF THE PREFERRED EMBODIMENT

Figure 1:
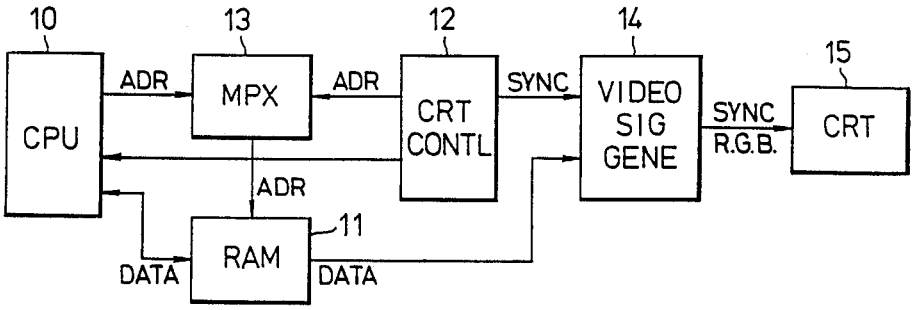
FIG. 1 PRIOR ART
FIG. 1 is a system block diagram showing an example of the conventional image display system.

In an example of the conventional image display system shown in FIG. 1, a central processing unit (CPU) 10 reads and writes image data from and into a random access memory (RAM) 11 by making access to the RAM 11 at an address which is supplied from the CPU 10 to the RAM 11 via a multiplexer 13. A CRT controller 12 makes access to the RAM 11 so as to read out displaying image data from the RAM 11, and the read out image data are supplied to a video signal generating circuit 14. The multiplexer 13 carries out an address multiplexing so that only one of the CPU 10 and the CRT controller 12 makes access to the RAM 11 at one time. The video signal generating circuit 14 converts the read out image data into primary color signals of red, green and blue responsive to a synchronizing signal from the CRT controller 12. The primary color signals are supplied to a CRT 15 and a picture described by the read out image data is displayed on the CRT 15.

Even within a horizontal scanning period, there exists a non-access interval in which the CRT controller 12 does not make access to the RAM 11, but this non-access interval is considerably short compared to a horizontal blanking period. For this reason, even if a control signal indicating a start of this non-access interval is supplied from the CRT controller 12 to the CPU 10, it takes time for the CPU 10 to actually receive the control signal and switch the multiplexer 13 so as to make access to the RAM 11. Therefore, it is impossible to make access to the RAM 11 within the non-access interval.

Accordingly, even when an access request for making access to the RAM 11 is generated in the CPU 10, the CPU 10 must wait until the horizontal or vertical blanking period is reached before the access to the RAM 11 may be made. Thus, there are problems in that the processing efficiency of the CPU 10 is poor and the access speed to the RAM 11 is slow.

On the other hand, in a character and pattern telephone access information network (CAPTAIN) system, for example, the image data are transmitted to the CPU 10 irrespective of the scanning period and the blanking period. Hence, even within a horizontal scanning period, the CPU 10 must make access to the RAM 11 and carry out operations such as writing the image data into the RAM 11. As a result, there is a problem in that the conventional CRT controller 12 cannot cope with such operations.

Furthermore, there are cases where the color of the displayed picture is changed into a predetermined color, such as the case where the displayed picture is changed to an all white picture. In this case, the CPU 10 makes access to the RAM 11 and initializes the RAM 11 by rewriting all of the image data into white image data. The RAM 11 is normally initialized within the vertical blanking period, but since the CPU 10 rewrites all of the image data in the RAM 11 during this initializing period, the CPU 10 cannot carry out other processes during this initializing period. Therefore, there is a problem in that the processing efficiency of the CPU 10 is poor.

Accordingly, the present invention provides a CRT controller which makes it possible to improve the processing efficiency of the CPU and make access to the memory by the CPU at a high speed.

Figure 2:
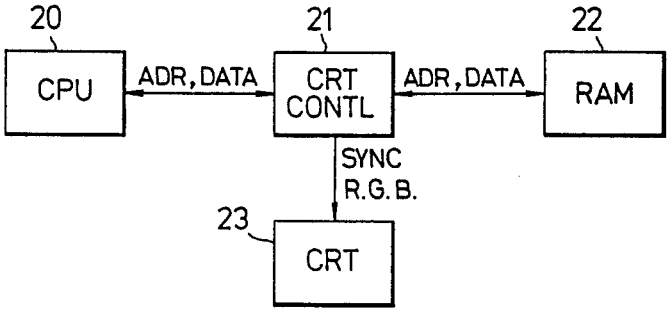
FIG. 2 is a system block diagram showing an image display system applied with a cathode ray tube controller according to the present invention for explaining the operating principle of the present invention.

FIG. 2 shows an image display system which is applied with the CRT controller according to the present invention. In FIG. 2, a CPU 20 is coupled to a CRT controller 21, and the CRT controller 21 is coupled to a RAM 22 and to a CRT 23. In order to carry out a display, the CRT controller 21 makes access to the RAM 22 with a predetermined period within the horizontal scanning period so as to read out the image data. The CRT controller 21 converts the read out image data into primary color signals of red (R), green (G) and blue (B) which constitute a video signal. The CRT controller 21 also generates a synchronizing signal, and the synchronizing signal and the primary color signals are supplied to the CRT 23 and a picture is displayed on the CRT 23.

The address in the RAM 22 to which the CPU 20 makes access and the write-in image data are held in the CRT controller 21, and the write and read operations with respect to the RAM 22 are carried out for the address which is held during a time period in which the CRT controller 21 does not make access to the RAM 22 for the purpose of display.

Figure 3:
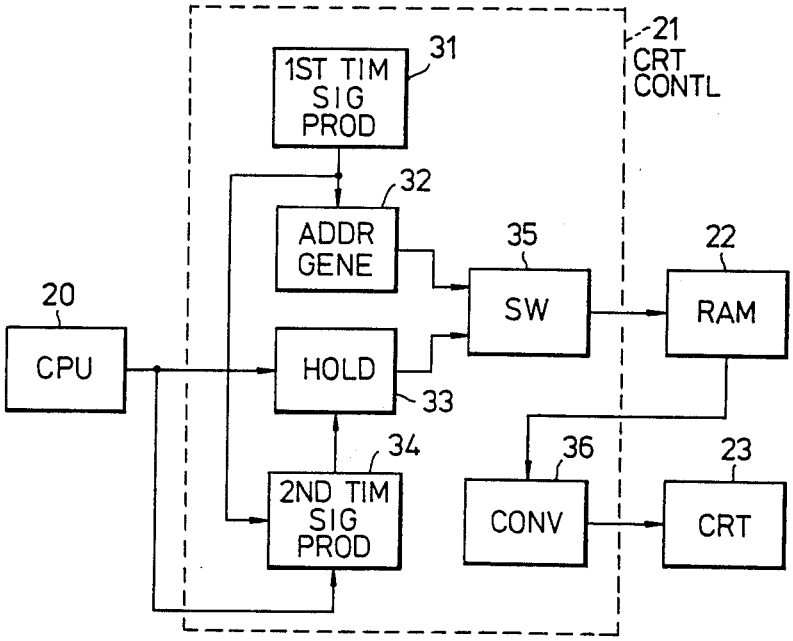
FIG. 3 is a system block diagram showing an embodiment of the cathode ray tube controller according to the present invention together with other parts of the image display system shown in FIG. 2.

FIG. 3 is a system block diagram showing an embodiment of the CRT controller according to the present invention together with other parts of the image display system shown in FIG. 2. In FIG. 3, those parts which are the same as those corresponding parts in FIG. 2 are designated by the same reference numerals, and a description thereof will be omitted. In FIG. 3, the CRT controller 21 comprises a first timing signal producing means 31, an address generating means 32, a holding means 33, a second timing signal producing means 34, a switching means 35 and a converting means 36.

The first timing signal producing means 31 produces a read-out timing signal for display having a predetermined period dependent on a display mode within the horizontal scanning period. The address generating means 32 is supplied with the read-out timing signal from the first timing signal producing means 31 and generates an address for successively making access to the RAM 22 which stores the image data. The displaying image data read out from the RAM 22 are converted into a video signal in the converting means 36, and the video signal is supplied to the CRT 23. This video signal is used to carry out a display on the CRT 23 for a time longer than an access time of the RAM 22. The holding means 33 at least holds the write-in address and the write-in image data or the read-out address from the CPU 20. The second timing signal producing means 34 is supplied with a trigger signal from the CPU 20. The trigger signal indicates the start of the write or read operation, and the second timing signal producing means 34 produces a write-in/read-out timing signal during a time period in which the read-out timing signal is not produced by the first timing signal producing means 31. The switching means 35 supplies to the RAM 22 the write-in address and the write-in image data or the read-out address which are held in the holding means 33 when the write-in/read-out timing signal is produced, so as to carry out the write or read operation with respect to the RAM 22.

In the present embodiment, the write-in address and the write-in image data or the read-out address from the CPU 20 are held in the holding means 33 of the CRT controller 21. The access to the RAM 22 is made by use of the write-in address or the read-out address when the write-in/read-out timing signal is produced within the horizontal scanning period, so as to write or read the image data into or from the RAM 22.

Figure 4:
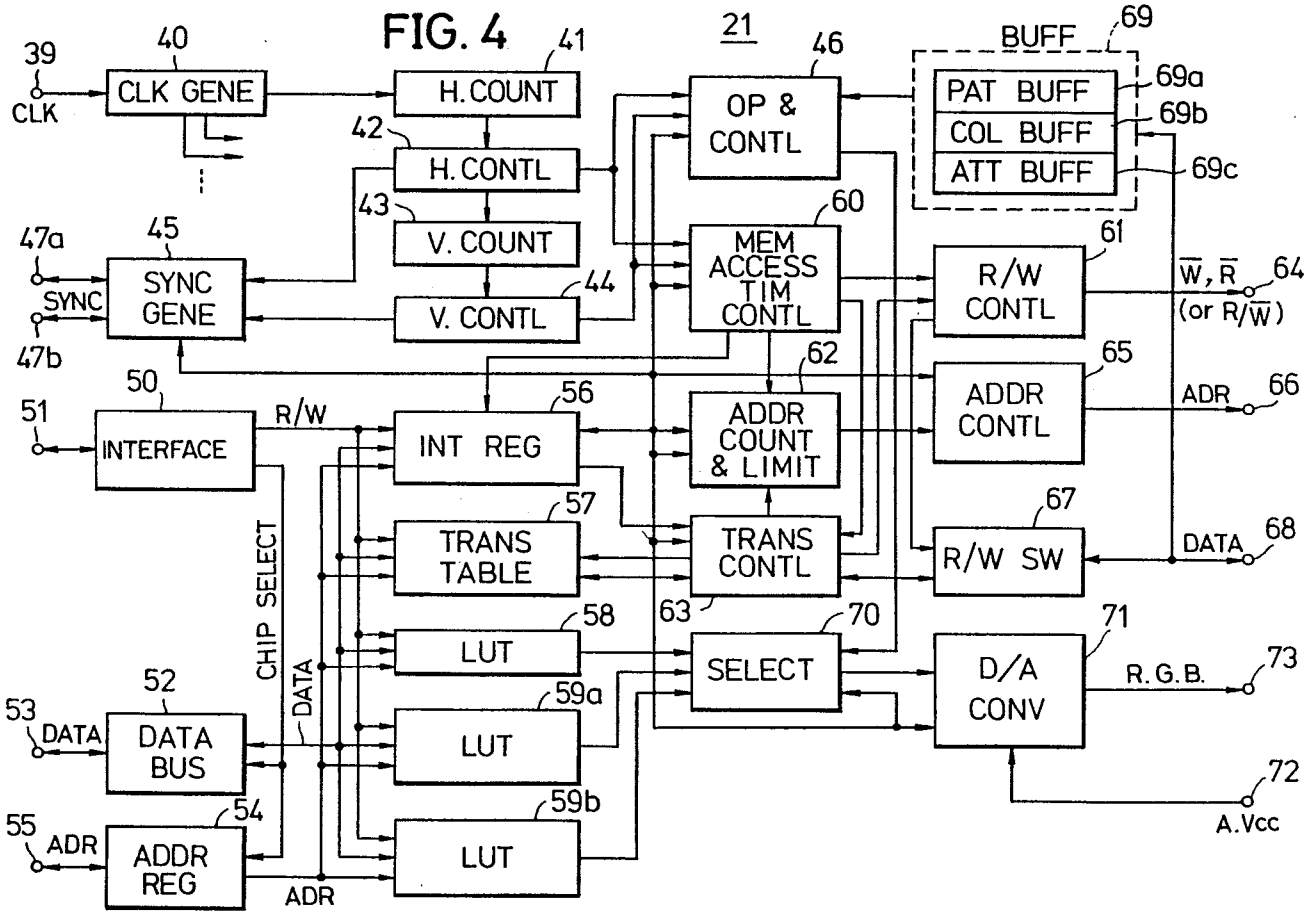
FIG. 4 is a system block diagram showing a more detailed construction of the cathode ray tube controller shown in FIG. 3.

FIG. 4 is a system block diagram showing a more detailed construction of the CRT controller 21. A system clock signal of the image display system is applied to a terminal 39 and is supplied to a clock generating circuit 40 which generates from the system clock signal various clock signals including a dot clock signal. The dot clock signal corresponds to each dot (picture element) constituting the picture which is displayed. The dot clock signal is supplied to a horizontal counter 41 and to other circuits within the CRT controller 21, but the illustration of the signal lines for the dot clock signal supplied to the other circuits within the CRT controller 23 will be omitted for convenience' sake. The other clock signals generated from the clock generating circuit 40 are supplied to various circuits within the CRT controller 21, but the illustration of the signal lines for these other clock signals will be omitted for convenience' sake.

The horizontal counter 41 counts the pulses of the dot clock signal and a counted value is supplied to a horizontal controller 42. The horizontal controller 42 compares the counted value from the horizontal counter 41 with a predetermined value and produces a pulse for every one horizontal scanning period. The output pulses of the horizontal controller 42 are counted in a vertical counter 43 and a counted value is supplied to a vertical controller 44. The vertical controller 44 compares the counted value from the vertical counter 43 with a predetermined value and produces a pulse for every one vertical scanning period.

The output pulse of the horizontal controller 42 and the vertical controller 44 are supplied to a synchronizing signal generating circuit 45 which generates therefrom a horizontal synchronizing signal and a vertical synchronizing signal. The horizontal and vertical synchronizing signals are supplied to an operation and control circuit 46 which will be described later, and are also supplied to the CRT 23 via terminals 47*a* and 47*b*. In addition, when carrying out a superimposed display by superimposing an image produced by the image display system and another image one on the other, horizontal and vertical synchronizing signals of the other image are supplied to the synchronizing signal generating circuit 45 via the terminals 47*a* and 47*b* so as to obtain synchronism with the CRT controller 21.

An interface circuit 50 is coupled to the CPU 20 via a terminal 51, and various control signals from the CPU 20 are received by the interface circuit 50. A data bus 52 and an address register 54 are coupled to the CPU 20 via respective terminals 53 and 55. The interface circuit 50 supplies a chip select signal to the data bus 52 and the address register 54.

An internal register 56 stores initializing image data and a trigger signal obtained from the CPU 20 via the data bus 52, the address in the RAM 22 designated by the CPU 20 and obtained via the address register 54 and the like. A transfer table 57 stores the write-in image data obtained from the CPU 20 via the data bus 52, the image data read out from the RAM 22 and supplied to the CPU 20 and the like. The holding means 33 shown in FIG. 3 is constituted by the internal register 56 and the transfer table 57. The contents of a look-up table 58 are fixed, but the contents of look-up tables 59*a* and 59*b* are rewritable by the CPU 20. The address from the address register 54 and the read/write signal from the interface circuit 50 are supplied to the internal register 56, the transfer table 57 and the look-up tables 58, 59*a* and 59*b*. The internal register 56, the transfer table 57 and the look-up tables 58, 59*a* and 59*b* are each coupled to the data bus 52.

The address supplied to the address register 54 from the CPU 20 via the terminal 55 designates to which one of the internal register 56, the transfer table 57 and the look-up table 59*a* and 59*b* the incoming data, address and the like to the data bus 52 are to be supplied.

The image display is carried out in display blocks. In a first display mode, the display block is constituted by eight dots in the horizontal direction by twelve dots in the vertical direction. In a second display mode, the display block is constituted by six dots in the horizontal direction by ten dots in the vertical direction.

Regardless of the first and second display modes, the image data is made up of pattern data having eight bits per word and describing one dot with one bit, color data having eight bits per word and describing a foreground color in four bits and describing a background color in four bits, and attribute data having eight bits per word and describing an attribute such as an underline display, a blink display and the like. In the second display mode, only six bits in one word of the pattern data are used and the remaining two bits are unused bits.

The first and second timing signal producing means 31 and 34 shown in FIG. 3 are constituted by a memory access timing controller 60. The memory access timing controller 60 is supplied with the dot clock signal, the horizontal and vertical synchronizing signals, the output pulses of the horizontal and vertical controllers 42 and 44, and a display mode control signal from the internal register 56. Based on these signals, the memory access timing controller 60 supplies to a read/write controller 61 a control signal for controlling the write/-read operation of the RAM 22. In addition, the memory access timing controller 60 supplies to an address counter and limiter 62 a control signal for varying the address value in the RAM 22, and supplies to a transfer control circuit 63 a control signal for controlling the transfer.

The read/write controller 61 constitutes the switching means 35 shown in FIG. 3 together with a read/-write switching circuit 67 which will be described later. The read/write controller 67 produces a read enable signal during a read operation and a write enable signal during a write operation, and the read/write enable signal is supplied to the RAM 22 via a terminal 64.

The address counter a limiter 62 constitutes the address generating means 32 shown in FIG. 3. An output address of the address counter and limiter 62 is supplied to an address controller 65 and is converted into an address format suited for making access to the RAM 22. Such an address format conversion is carried out because the address format differs depending on whether a dynamic RAM or a static RAM is used for the RAM 22.

The displaying image data read out from the RAM 22 are supplied to a buffer 69 via a terminal 68, and the pattern data, the color data and the attribute data are independently stored in a pattern buffer 69*a*, a color buffer 69*b* and an attribute buffer 69*c* within the buffer 69, respectively. The operation and control circuit 46 carries out operations on the pattern data, the color data and the attribute data received from the buffer 69, and supplies to a selector 70 color code data which are produced in units of dots.

The selector 70 converts the color code data into primary color data having a total of twelve bits by use of a table which is selected out of the look-up tables 58, 59*a* and 59*b* according to an instruction from the internal register 56. The twelve-bit primary color data have four bits allocated for each of the three primary colors of red, green and blue. The primary color data are supplied to a digital-to-analog (D/A) converter 71 and are converted into analog primary color signals of red (R), green (G) and blue (B) by use of a reference voltage obtained from a terminal 72. The primary color signals of red (R), green (G) and blue (B) are supplied to the CRT 23 via a terminal 73 and the CRT 23 displays the picture thereon. The look-up tables 58, 59*a* and 59*b*, the buffer 69, the operation and control circuit 46, the selector 70 and the D/A converter 71 constitute the converting means 36 shown in FIG. 3.

Next, a description will be given on the operation of the CPU 20 for carrying out the write and read operations with respect to the RAM 22.

The information from the CPU 20 such as the write-in and read-out addresses, the number of transferring words and the access method is obtained from the terminal 53. The information from the terminal 53 is supplied to the internal register 56 via the data bus 52 and is stored in the internal register 56. On the other hand, the write-in image data from the CPU 20 such as the pattern data, the color data and the attribute data are also obtained from the terminal 53. The write-in image data from the terminal 53 are supplied to the transfer table 57 via the data bust 52 and are stored in the transfer table 57. The access method mentioned above refers to the instructing of an automatic increment in which the address is automatically incremented, a logical write in which image data obtained by carrying out a logical operation on the write-in image data and the image data stored in the RAM 22 are written into the RAM 22 and the like. A trigger signal from the CPU 20 which indicates the start of the access is supplied to the internal register 56 via the data bus 52 and is stored in the internal register 56.

Figure 5:
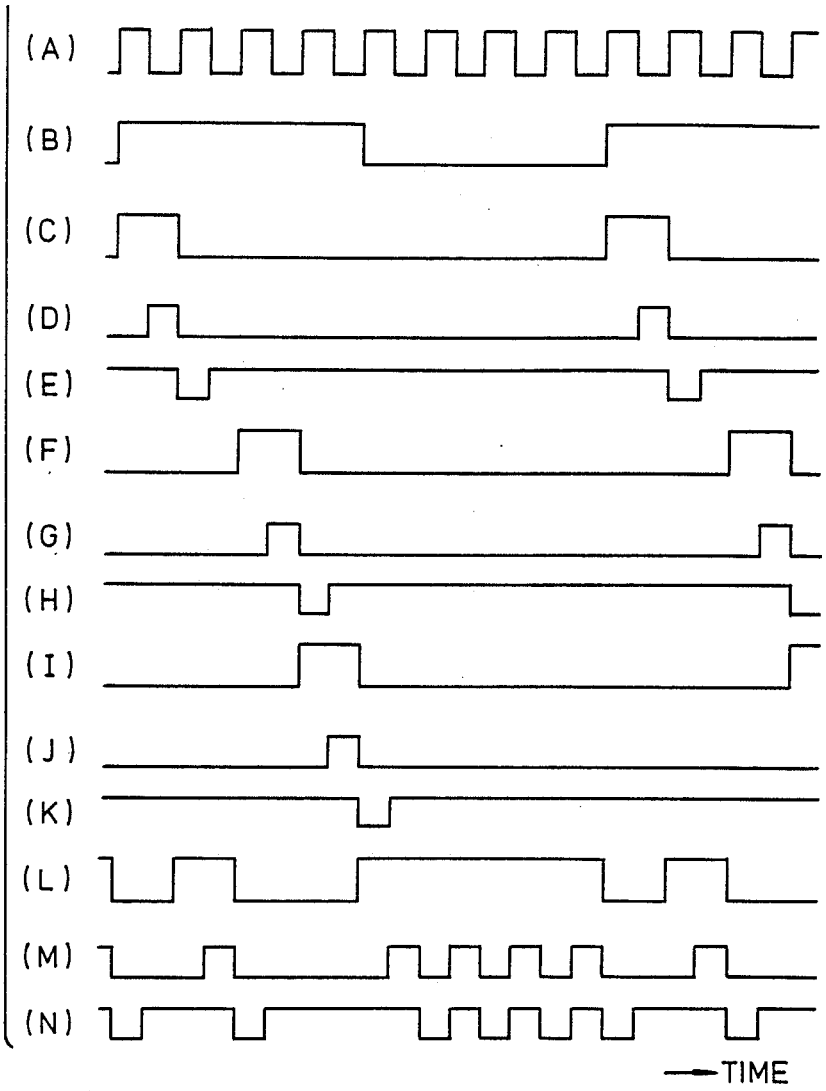
FIGS. 5(A) through 5(N) are timing charts for explaining the operation of the block system shown in FIG. 4.

The dot clock signal shown in FIG. 5(A) generated from the clock generating circuit 40 is also supplied to the memory access timing controller 60. One period of this dot clock signal corresponds to a display time period for displaying two dots. Each bit in the pattern data describes one dot, but in the first and second display modes, an enlarged display is carried out by displaying two dots in the horizontal direction by two dots in the vertical direction by use of one bit in the pattern data. For this reason, sixteen dots in the horizontal direction are displayed by the pattern data, the color data and the attribute data each amounting to one word during the first display mode. On the other hand, twelve dots in the horizontal direction are displayed by the pattern data, the color data and the attribute data each amounting to one word during the second display mode.

When the first display mode is instructed, the memory access timing controller 60 produces a display timing signal shown in FIG. 5(B) from the dot clock signal shown in FIG. 5(A) during the horizontal scanning period. When the second display mode is instructed, the memory access timing controller 60 produces a display timing signal by frequency-dividing the dot clock signal shown in FIG. 5(A) by 1/6.

The memory access timing controller 60 produces read timing signals (read timing signals for display) shown in FIGS. 5(C), 5(F) and 5(I) for the pattern data, the color data and the attribute data, respectively, in synchronism with the display timing signal. In addition, the memory access timing controller 60 produces a load signal shown in FIG. 5(D) and a save signal shown in FIG. 5(E) from the read timing signal for the pattern data shown in FIG. 5(C), and produces a load signal shown in FIG. 5(G) and a save signal shown in FIG. 5(H) from the read timing signal for the color data shown in FIG. 5(F). Furthermore, the memory access timing controller 60 produces a load signal shown in FIG. 5(J) and a save signal shown in FIG. 5(K) from the read timing signal for the attribute data shown in FIG. 5(I).

When the memory access timing controller 60 is supplied with the trigger signal from the internal register 56, the memory access timing controller 60 carries out a NOR operation on the read timing signals shown in FIGS. 5(C), 5(F) and 5(I) and produces a read/write timing signal shown in FIG. 5(L). The memory access timing controller 60 also produces a load signal shown in FIG. 5(M) and a save signal shown in FIG. 5(N) from the read/write timing signal shown in FIG. 5(L).

Figure 6:
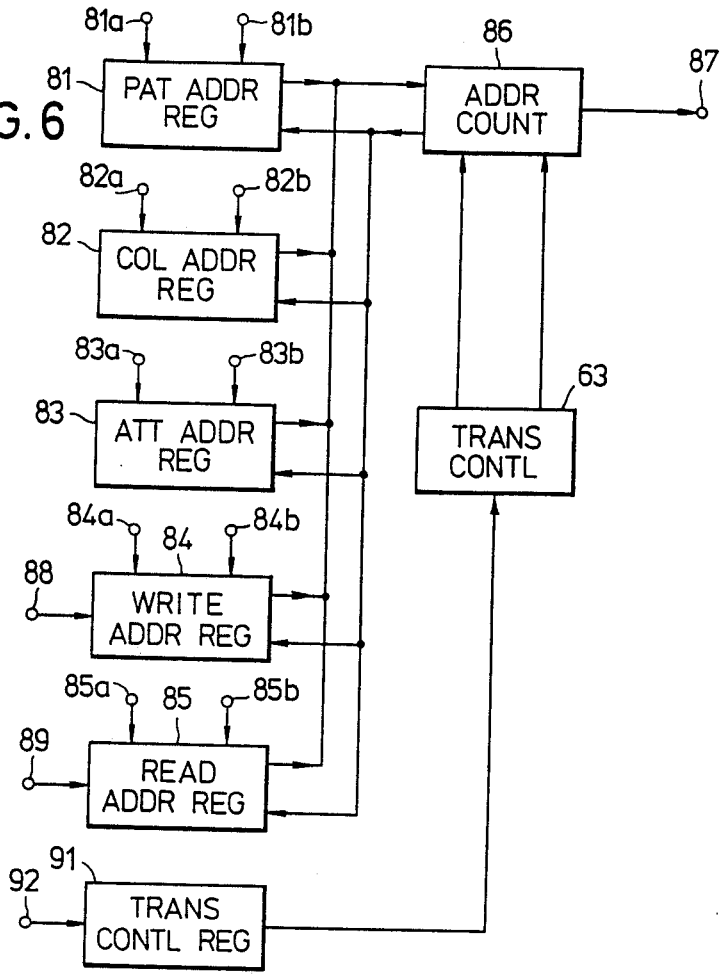
FIG. 6 is a system block diagram showing an embodiment of an essential part of the block system shown in FIG. 4.

The pairs of load and save signals are supplied to respective registers 81 through 85 shown in FIG. 6 within the internal register 56. FIG. 6 shows essential parts of the internal register 56 and the address counter and limiter 62 together with the transfer control circuit 63. The pattern address register 81 stores the read-out address of the displaying pattern data, and loads the read-out address into an address counter 86 within the address counter and limiter 62 during a high-level period of the load signal shown in FIG. 5(D) which is supplied to a terminal 81*a*. The address loaded into the address counter 86 is supplied to the address controller 65 via a terminal 87. In addition, the pattern address register 81 saves the address supplied from the address counter 86 during a low-level period of the save signal shown in FIG. 5(E) which is supplied to a terminal 81*b*. The address counter 86 increments the address responsive to a control signal which is obtained from the transfer control circuit 63.

The color address register 82 stores the read-out address of the displaying color data, and loads the read-out address into the address counter 86 during a high-level period of the load signal shown in FIG. 5(G) which is supplied to a terminal 82*a*. In addition, the color address register 82 saves the address supplied from the address counter 86 during a low-level period of the save signal shown in FIG. 5(H) which is supplied to a terminal 82*b*.

The attribute address register 83 stores the read-out address of the displaying attribute data, and loads the read-out address to the address counter 86 during a high-level period of the load signal shown in FIG. 5(J) which is supplied to a terminal 83*a*. Further, the attribute address register 83 saves the address supplied from the address counter 86 during a low-level period of the save signal shown in FIG. 5(K) which is supplied to a terminal 83*b*.

The write address register 84 stores the write-in address from the CPU 20 obtained via the terminal 55, the address register 54 and a terminal 88, and loads the write-in address into the address counter 86 during a high-level period of the load signal shown in FIG. 5(M) which is supplied to a terminal 84*a*. In addition, the write address register 84 saves the address supplied from the address counter 86 during a low-level period of the save signal shown in FIG. 5(N) which is supplied to a terminal 84*b*.

The read address register 85 stores the read-out address from the CPU 20 obtained via the terminal 55, the address register 54 and a terminal 89, and loads the read-out address into the address counter 86 during a high-level period of the load signal shown in FIG. 5(M) which is supplied to a terminal 85*a*. Further, the read-out address register 85 saves the address supplied from the address counter 86 during a low-level period of the save signal shown in FIG. 5(N) which is supplied to a terminal 85*b*.

The address loaded into the address counter 86 and outputted therefrom is supplied via the terminal 87 to the address controller 65 wherein the address is converted into an address format suited for making access to the RAM 22, and the address having the converted address format is then supplied to the RAM 22.

The information from the CPU 20 such as the instructions on the number of transferring words, the automatic increment and the logical write are supplied to a transfer control register 91 of the internal register 56 via the terminal 53, the data bus 52 and a terminal 92. These instructions are supplied to the transfer control circuit 63 from the transfer control register, and out of these instructions, the instruction on the automatic increment is supplied to the address counter 86. In FIG. 6, the illustration of other signal lines to and from the transfer control circuit 63 is omitted for convenience' sake.

At the same time, the read/write controller 61 responsive to a control signal from the memory access timing controller 60 supplies a write enable signal to the RAM 22 via the terminal 64 during high-level periods of the read timing signals shown in FIGS. 5(C), 5(F) and 5(I). In addition, the read/write controller 61 supplies a write enable signal (when carrying out a write operation from the CPU 20) or a read enable signal (when carrying out a read operation from the CPU 20) to the RAM 22 via the terminal 64 during a high-level period of the read/write timing signal shown in FIG. 5(L).

The read/write switching circuit 67 is set to a floating mode when producing the read timing signal responsive to a control signal from the read/write controller 61. The image data read out from the RAM 22 and obtained via the terminal 68 are supplied to the buffer 69.

When carrying out the write operation from the CPU 20, the image data within the transfer table 57 are successively supplied to the transfer control circuit 63 for every one period of the dot clock signal during a high-level period of the read/write timing signal. The transfer control circuit 63 selects the image data and supplies the selected image data to the read/write switching circuit 67. The read/write switching circuit 67 is set to the write mode responsive to a control signal from the read/write controller 61, and the image data are supplied to the RAM 22 via the terminal 68.

Accordingly, even during the horizontal scanning period, the image data from the CPU 20 are successively written into the RAM 22.

Similarly, when carrying out the read operation from the CPU 20, the image data read out from the RAM 22 for every one period of the dot clock signal during a high-level period of the read/write timing signal are supplied to the read/write switching circuit 67 via the terminal 68. The read/write switching circuit 67 is set to the read mode responsive to a control signal from the read/write controller 61, and the image data are supplied to the transfer control circuit 63. The transfer control circuit 63 selects the image data, and the selected image data are supplied to the transfer table 57 and stored therein.

Therefore, even during the horizontal scanning period, it is possible to read out the image data different from the displaying image data. The image data stored in the transfer table 57 are supplied to the CPU 20 via the data bus 52 and the terminal 53 according to an instruction from the CPU 20.

When an number of words of the image data identical to the number of transferring words are written into or read out from the RAM 22, the memory access timing controller 60 forcibly sets the read/write timing signal to a low level. As a result, the write or read operation with respect to the RAM 22 from the CPU 20 is stopped.

The CPU 20 supplies to the CRT controller 21 the write-in address and the write-in image data or the read-out address for the RAM 22 at a time when the access request is generated, and can thereafter carry out other processes. Hence, the processing efficiency of the CPU 20 is improved compared to the conventional system. In addition, the write and read operations can be carried out at a high speed because the CPU 20 carries out the write and read operations with respect to the RAM 22 within the horizontal scanning period. Thus, the utilization efficiency of the data bus and the address bus between the CRT controller 21 and the RAM 22 is improved compared to the conventional system. Furthermore, the construction of the image display system is simple because there is no need to use a multiplexer circuit or the like for carrying out an address multiplexing between the addresses from the CPU 20 and the CRT controller 23.

The read timing signals shown in FIGS. 5(C), 5(F) and 5(I) are not produced during the horizontal blanking period and the vertical blanking period, but the read/write timing signal is produced. For this reason, it is of course possible to make access to the RAM 22 from the CPU 20 similarly as in the case of the conventional system.

Figure 7:
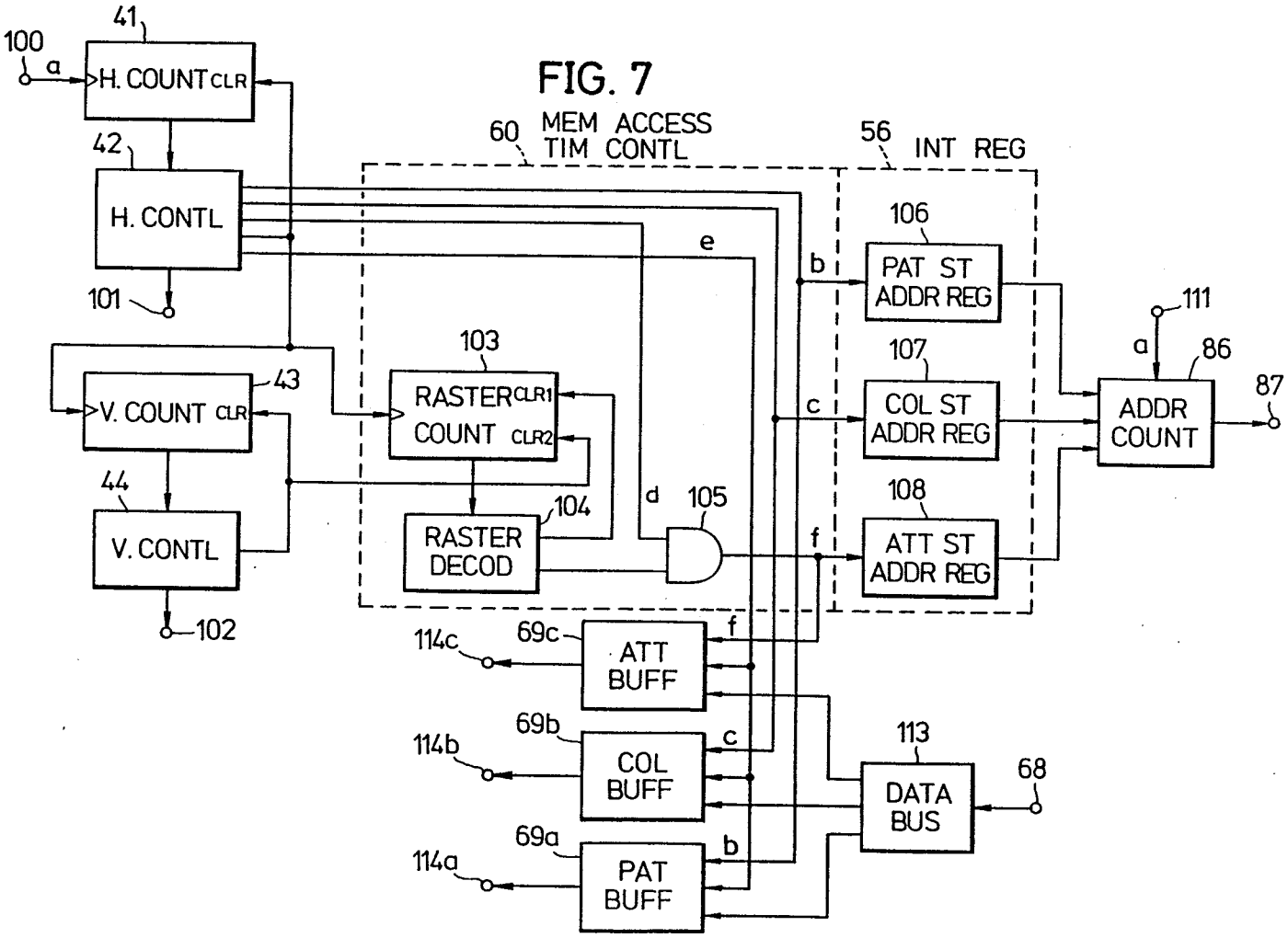
FIG. 7 is a system block diagram showing an embodiment of another essential part of the block system shown in FIG. 4.

FIG. 7 shows an embodiment of another essential part of the block system shown in FIG. 4. In FIG. 7, those parts which are the same as those corresponding parts in FIG: 4 are designated by the same reference numerals, and a description thereof will be omitted. In FIG. 7, the horizontal counter 41 counts pulses of a dot clock signal a shown in FIG. 8(A) from a terminal 100, and a counted value in the horizontal counter 41 is supplied to the horizontal controller 42. As described before, the dot clock signal a shown is obtained from the clock generating circuit 40 shown in FIG. 4, and in addition, two dots are displayed on the CRT 23 in one period of the dot clock signal a.

The horizontal controller 42 produces a horizontal clear signal when the counted value from the horizontal controller 42 becomes a value corresponding to one horizontal scanning period, and this horizontal clear signal is supplied to a clear terminal CLR of the horizontal counter 41 to clear the horizontal counter 41. The horizontal controller 42 also produces timing signals b, c, d and e respectively shown in FIGS. 8(B), 8(C), 8(D) and 8(E) during the first display mode.

The timing signal b instructs the outputting of the pattern address, and is produced during the horizontal scanning period for every eight clock periods. The timing signal b has a pulse width of one clock period. The timing signal c instructs the outputting of the color address. The timing signal c rises one clock period after a fall in the timing signal b, and has a pulse width of two clock periods. The timing signal d instructs the outputting of the attribute address. The timing signal d has a low level during the horizontal scanning period and rises to a high level during the horizontal blanking period, and has a pulse width of thirty-four clock periods. The timing signal e is identical to the timing signal b and instructs the outputting of the pattern, color and attribute data.

The horizontal counter 42 also produces a pulse for every one horizontal scanning period, and the output pulses of the horizontal controller 42 are supplied to the synchronizing signal generating circuit 45 shown in FIG. 4 via the terminal 101.

The horizontal clear signal from the horizontal controller 42 is further supplied to the vertical counter 43, and the vertical counter 43 counts the horizontal clear signal. A counted value in the vertical counter 43 is supplied to the vertical controller 44. The vertical controller 44 produces a vertical clear signal when the counted value becomes a value corresponding to one vertical scanning period. This vertical clear signal is supplied to a clear terminal CLR of the vertical counter 43 and clears the vertical counter 43. In addition, the vertical controller 44 produces a pulse for every one vertical scanning period, and the output pulses of the vertical controller 44 are supplied to the synchronizing signal generating circuit 45 via a terminal 102.

The horizontal clear signal is also supplied to a raster counter 103 within the memory access timing controller 60. The raster counter 103 counts the horizontal clear signal, and a counted value in the raster counter 103 is supplied to a raster decoder 104 within the memory access timing controller 60. The raster decoder 104 produces a gate signal having a high level during a time period in which the counted value from the raster counter 103 is "3" in the first display mode, and the output gate signal is supplied to a 2-input AND circuit 105 within the memory access timing controller 60. The raster decoder 104 produces a raster clear signal when the counted value from the raster counter 103 becomes "4", and this raster clear signal is supplied to a clear terminal CLR1 of the raster counter 103. On the other hand , the vertical clear signal is supplied to a clear terminal CLR2 of the raster counter 103. Hence, the raster counter 103 is cleared to "0" immediately before the start of the vertical scan, and is thereafter cleared to "0" for every four horizontal scanning periods.

The timing signal d from the horizontal controller 42 is supplied to the other input terminal of the AND circuit 105. In the first display mode, the AND circuit 105 obtains the timing signal d during the horizontal blanking period immediately after the display of the last fourth raster in the display block when the counted value in the raster counter 103 is "3", and an output of the AND circuit 105 is outputted as a timing signal f.

The timing signal b from the horizontal controller 42 is supplied to a pattern start address register 106 within the internal register 56 and to the pattern buffer 69*a* within the buffer 69. The timing signal c from the horizontal controller 42 is supplied to a color start address register 107 within the internal register 56 and to the color buffer 69*b* within the buffer 69. In addition, the timing signal e from the horizontal controller 42 is supplied to the pattern buffer 69*a*, the color buffer 69*b* and the attribute buffer 69*c* within the buffer 69. The timing signal f from the AND circuit 105 within the memory access timing controller 60 is supplied to an attribute start address register 108 within the internal register 56 and to the attribute buffer 69*c* within the buffer 69.

The start addresses stored in the start address registers 106, 107 and 108 within the internal register 56 are loaded into the address counter 86 within the address counter and limiter 62 when the respective timing signals b, c and f rise. Furthermore, the addresses in the address counter 86 are saved when the respective timing signals b, c and f fall. The address counter 86 increments the address responsive to the dot clock signal a from a terminal 111, and the output address of the address counter 86 is supplied to the address controller 65 shown in FIG. 4 via the terminal 87 so as to convert the address format into the address format suited for making access to the RAM 22.

For example, the RAM 22 comprises a pattern data region of approximately 7 kbyte, a color data region of approximately 0.35 kbyte, an attribute region of approximately 0.35 kbyte which are set in accordance with the start addresses. The 2-byte (16-bit) data is written into or read out from the RAM 22 responsive to one access address.

The pattern data, color data and attribute data read out from the RAM 22 in accordance with the output address of the address counter 86 are supplied to the respective pattern buffer 69*a* , the color buffer 69*b* and the attribute buffer 69*c* via the terminal 68 and a data bus 113.

The pattern buffer 69*a* latches the 2-byte pattern data amounting to four display blocks received during a high-level period of the timing signal b, and supplies the latched pattern data to the operation and control circuit 46 shown in FIG. 4 via a terminal 114*a* during a high-level period of the timing signal e. The color buffer 69*b* latches the 4-byte color data amounting to four display blocks received during a high-level period of the timing signal c, two bytes for every one clock period, and supplies the latched color data to the operation and control circuit 46 via a terminal **114*b* during the high-level period of the timing signal e. The attribute buffer 69*c* latches the 68-byte attribute data amounting to 68 display blocks received during a high-level period of the timing signal f, and supplies one byte of the latched attribute data to the operation and control circuit 46 via a terminal 114*c*** during the high-level period of the timing signal e.

One period of the dot clock signal a is approximately 350 nsec, and the memory cycle of the RAM 22 is approximately 350 nsec. In addition, one horizontal scanning period on the CRT 23 is 136 clock periods, the horizontal blanking period is 46 clock periods, one vertical display period on the CRT 23 is 204 horizontal scanning periods, and the vertical blanking period is 58 horizontal scanning periods.

In the first display mode, it is necessary to read out from the RAM 22 during one horizontal scanning period of a total of 170 bytes made up of 34 bytes of pattern data, 68 bytes of color data and 68 bytes of attribute data. Furthermore, a total of 204 bytes are required if a smoothing is to be carried out. For this reason, it is impossible to carry out the smoothing with one horizontal scanning period set to 182 clock periods when one byte (eight bits) of data is to be read out or written into the RAM 22 responsive to one access address. Thus, in the present embodiment, two bytes (16 bits) of data are read out or written into the RAM 22 responsive to one access address.

During the horizontal scanning period amounting to 136 clock periods, 34 bytes of pattern data are read out in 17 clock periods, 68 bytes of color data are read out in 34 clock periods, and the attribute data is read out during the horizontal blanking period. Therefore, the remaining 85 clock periods within the horizontal scanning period can be used for carrying out other processes in the CPU 20.

Figure 8:
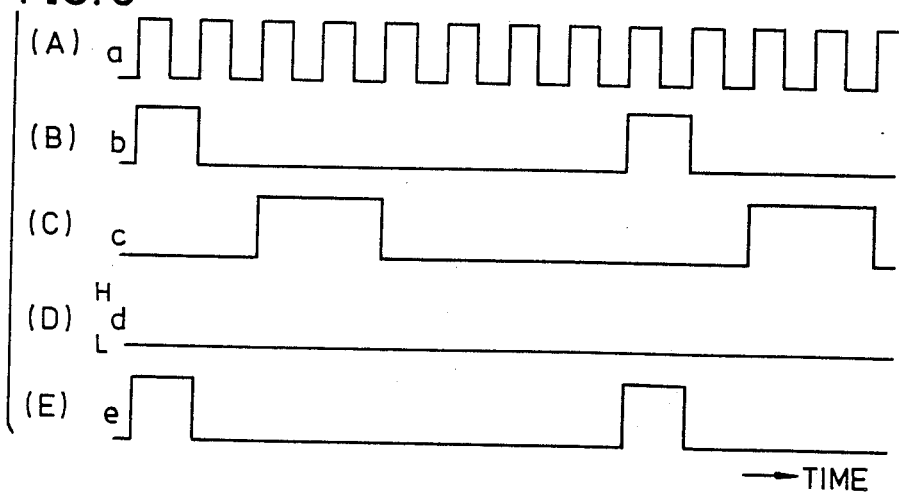
FIGS. 8(A) through 8(E) are timing charts for explaining the operation of the block system shown in FIG. 7.

It is possible to read out different image data from the RAM 22 during four clock periods from a fall in the timing signal c shown in FIG. 8(C) to a next rise in the timing signal b shown in FIG. 8(B), so as to produce another video signal different from the video signal described heretofore. In this case, it is possible to switch and display either one of two kinds of pictures described by the two mutually different video signals.

When it is assumed that the attribute data is read out from the RAM 22 for every line, it is necessary to read out 13872 ($=68\times204$) bytes of attribute data for one picture in the first display mode. But according to the present embodiment, the attribute data is read out during the horizontal blanking period for every four lines, and it is only necessary to read out 3468 bytes of attribute data for one picture. As a result, the access is made to the RAM 22 1734 times, and the number of times the access is made is only 25% of the number of times the access is made when the attribute data is read out for every line.

When writing the image data into the RAM 22 from the CPU 20, the information such as the write-in address and the number of transferring words outputted from the CPU 20 is supplied to the internal register 56 via the data bus 52, and is stored in the read address register within the internal register 56. The write-in image data are supplied to the transfer table 57 via the data bus 52 and are stored thereon. Furthermore, the trigger signal which indicates the start of the write-in or read-out operation (that is, the start of the access) is supplied to the internal register 56 from the CPU 20 via the data bus 52 and is stored in the internal register 56.

Responsive to the trigger signal, the memory access timing controller 60 produces a write timing signal which has a high level when all of the timing signals b, c and f have low levels. The address in the read address register within the internal register 56 is loaded into the address counter 86 during a high-level period of the write timing signal, and the loaded address is incremented with the clock period. The write-in address obtained from the address counter 86 is supplied to the RAM 22 via the terminal 87, the address controller 65 and the terminal 66.

At the same time, responsive to a control signal from the memory access timing controller 60, the read/write controller 61 supplies a write enable signal to the RAM 22 via the terminal 64. In addition, the image data within the transfer table 57 are successively supplied to the transfer control circuit 63 for every clock period during the high-level period of the write timing signal. The transfer control circuit 63 selects the image data and supplies the selected image data to the read/write switching circuit 67. The read/write switching circuit 67 is set to the write mode responsive to a control signal from the read/write controller 61, and the image data are supplied to the RAM 22 via the terminal 68.

Accordingly, it is possible to successively write the image data from the CPU 20 into the RAM 22 even during the horizontal scanning period.

Next, a description will be given on the initializing of the RAM 22. Initializing image data for initializing the RAM 22 are held in the CRT controller 21 shown in FIG. 2. When initializing the RAM 22, the CRT controller 21 writes image data into the RAM 22 instead of making access to the RAM 22 for the purpose of carrying out a display, and the initializing image data are converted into primary color signals of red (R), green (G) and blue (B) and displayed on the CRT 23.

The initializing image data outputted from the CPU 20, that is, the initializing pattern data, color data and attribute data, are supplied to the internal register 56 via the terminal 53 and the data bus 52 and are stored in the internal register 56. In addition, a trigger signal indicating a start of the initializing operation is obtained from the CPU 20 and is supplied to the internal register 56 via the terminal 53 and the data bus 52. The internal register 56 also stores this trigger signal.

When the trigger signal outputted from the internal register 56 is supplied to the memory access timing controller 60, the memory access timing controller 60 supplies a control signal to the read/write controller 61 and to the transfer control circuit 63.

The transfer control circuit 63 obtains the initializing image data from the internal register 56 and supplies the initializing image data to the read/write switching circuit 67 responsive to the control signal from the memory access timing controller 60. At the same time, the read/write controller 61 supplies a write enable signal to the RAM 22 via the terminal 64 responsive to the control signal from the memory access timing controller 60. In addition, the read/write switching circuit 67 is set to the write mode responsive to a control signal from the read/write controller 61, and the initializing image data selected in the transfer control circuit 63 are supplied to the RAM 22 via the terminal 68 and also to the buffer 69.

The address counter and limiter 62 continues to generate the address even when the trigger signal is received within the read-out period of the displaying image data. On the other hand, when the trigger signal is received within a non-read-out period, the address counter and limiter 62 generates the address for making access to the RAM 22 responsive to a control signal from the memory access timing controller 60 when the horizontal scanning period is reached, similarly as in the case of the read-out of the displaying image data. The address generated from the address counter and limiter 62 is converted in the address controller 65 into the address format suited for making access to the RAM 22 and is supplied to the RAM 22 via the terminal 66.

Accordingly, when the trigger signal is received, the image data amounting to one picture stored in the RAM 22 are all rewritten into the initializing image data in one vertical scanning period from a time when the read/-write controller 61 produces the write enable signal.

At the same time, the initializing image data stored in the buffer 69, that is, the pattern data, the color data and the attribute data, is subjected to an operation in the operation and control circuit 46 and is processed into color data in units of dots. The color data are converted into 12-bit primary color data by use of one of the look-up tables 58, 59*a* and 59*b*. The primary color data are converted into initializing primary color signals of red (R), green (G) and blue (B) in the D/A converter 71 and are supplied to the CRT 23 via the terminal 73. In other words, when the trigger signal is received, the CRT 23 displays a picture described by the initializing image data and the displayed picture is changed into a predetermined picture such as an all-white picture.

Hence, when initializing the RAM 22, the CPU 20 simply needs to supply the initializing image data and the trigger signal to the CRT controller 21. During the one vertical scanning period in which the CRT controller 21 initializes the RAM 22, the CPU 20 can carry out other processes, and the processing efficiency of the CPU 20 is improved compared to the conventional system.

During the initializing of the RAM 22, the address counter and limiter 62 within the CRT controller 21 carries out an operation identical to that carried out during the read-out of the displaying image data from the RAM 22, and only the output of the read/write controller 61 changes from the read enable signal produced during the read-out to the write enable signal. Therefore, the control of the CRT controller 21 is simple.

Figure 9:
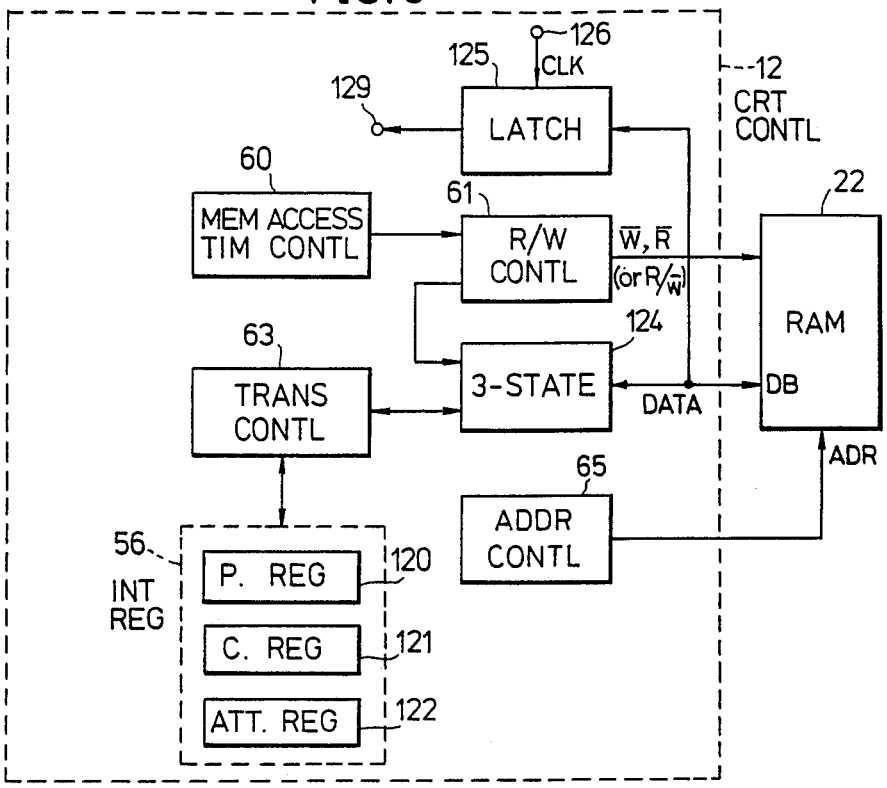
FIG. 9 is a system block diagram showing an essential part of the image display system applied with the cathode ray tube controller according to the present invention for explaining the initializing of a random access memory.

FIG. 9 shows an essential part of the image display system applied with the CRT controller according to the present invention, for explaining the initializing operation of the RAM. In FIG. 9, those parts which are the same as those corresponding parts in FIG. 4 are designated by the same reference numerals, and a description thereof will be omitted. The internal register 56 comprises three registers 120, 121 and 122 for independently storing the pattern, color and attribute data of the initializing image data. The initializing image data from the internal register 56 are supplied to a three-state circuit 124 via the transfer control circuit 63. The three-state circuit 124 constitutes the read/write switching circuit 67 shown in FIG. 4, and the read/write mode thereof is controlled responsive to the control signal from the read/write controller 61.

During the initializing operation, the initializing image data are supplied to the RAM 22 in the write mode and the initializing image data are simultaneously supplied to a latch circuit 125 within the buffer 69. This latch circuit 125 is supplied with a clock signal CLK from the memory access timing controller 60 via a terminal 126. The address from the address controller 65 is supplied to the RAM 22. Hence, when the three-state circuit 124 is set to the write mode during the initializing operation, the latch circuit 125 latches the initializing image data and supplies the initializing image data to other parts of the buffer 69 via a terminal 129, so that the initializing image data which are written into the RAM 22 are simultaneously displayed on the CRT 23.

Figure 10:
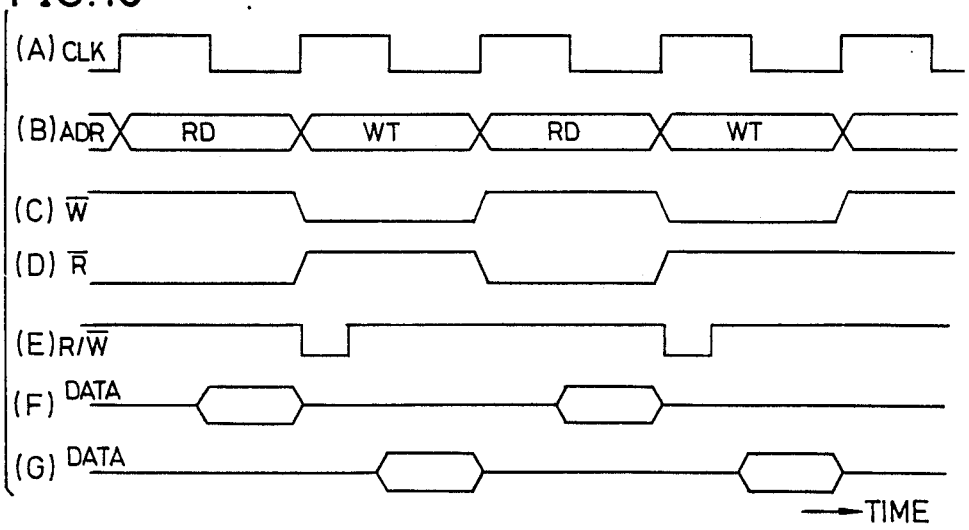
FIGS. 10(A) through 10(G) are timing charts for explaining the operation of the block system shown in FIG. 9.

FIGS. 10(A) and 10(B) respectively show the clock signal CLK supplied to the terminal 126 and the address supplied to the RAM 22, where RD and WT in FIG. 10(B) respectively denote the read-out address and the write-in address. In the case where the static RAM is used for the RAM 22, the read/write controller 61 supplies to the RAM 22 the write enable signal $\overline{W}$ shown in FIG. 10(C) or the read enable signal $\overline{R}$ shown in FIG. 10(D). On the other hand, in the case where a dynamic RAM is used for the RAM 22, a read/write enable signal $R/\overline{W}$ shown in FIG. 10(E) is supplied to the RAM 22. Hence, the image data are read out from the RAM 22 with a timing shown in FIG. 10(F) and are written into the RAM 22 with a timing shown in FIG. 10(G).

Further, the present invention is not limited to these embodiments, and various variations and modifications may be made without departing from the scope of the present invention.

What is claimed is:

1. A cathode ray tube controller for controlling address and data transfer between a central processing unit which supplies a trigger signal and a memory which stores image data, and for controlling a display on a cathode ray tube, said cathode ray tube controller comprising:

first timing signal producing means for producing, during a horizontal scanning period, a display timing signal having a predetermined period dependent on a display mode;

address generating means for generating an address, responsive to said display timing signal, for successively making access to the memory which stores image data;

holding means for holding at least a write-in address and one of write-in image data and a read-out address which are supplied from the central processing unit, said holding means comprising:

an internal register, coupled to the central processing unit, for storing at least the trigger signal, initializing image data for initializing the memory and an access address of the memory which are supplied from the central processing unit; and a transfer table, coupled to the central processing unit, for storing the write-in image data supplied from the central processing unit and the image data read out from the memory to be supplied to the central processing unit, the image data comprising pattern data describing a pattern of the image data, color data describing foreground and background colors of the image data and attribute data describing an attribute of the image data, said internal register comprising registers for independently storing the pattern data, the color data and the attribute data, said address generating means generating addresses for time-divisionally reading out the pattern data, the color data and the attribute data from the memory during a horizontal scanning period, so that at least one of the color data and the attribute data are read out during a horizontal blanking period and a predetermined time period within the horizontal scanning period is unused for the read-out of the pattern data, the color data and the attribute data;

second timing signal generating means supplied with the trigger signal from the central processing unit for producing a write/read timing signal when no display timing signal is produced by said first timing signal producing means, the trigger signal indicating a start of a write/read operation; and switching means for selectively supplying to the memory the write-in address and the write-in image data or the read-out address held in said holding means responsive to the write/read timing signal so as to carry out a write/read operation with respect to the memory.

2. A cathode ray tube controller for controlling address and data transfer between a central processing unit which supplies a trigger signal and a memory which stores image data, and for controlling a display on a cathode ray tube, said cathode ray tube controller comprising:

first timing signal producing means for producing, during a horizontal scanning period, a display timing signal having a predetermined period dependent on a display mode;

address generating means for generating an address, responsive to the display timing signal, for successively making access to the memory which stores image data;

holding means for holding at least a write-in address and one of write-in image data and a read-out address which are supplied from the central processing unit, the trigger signal also indicating a start of an initializing operation in which contents of the memory are initialized, said holding means holding initializing image data for initializing the memory supplied from the central processing unit;

second timing signal generating means supplied with the trigger signal from the central processing unit for producing a write/read timing signal when no display timing signal is produced by said first timing signal producing means, the trigger signal indicating a start of a write/read operation;

switching means for selectively supplying to the memory the write-in address and the write-in image data or the read-out address held in said holding means responsive to the write/read timing signal so as to carry out a write/read operation with respect to the memory; and converting means for converting image data into a display signal, said second timing signal producing means producing a write timing signal responsive to the trigger signal indicative of the start of the initializing operation, so that the initializing image data received by said switching means from the central processing unit via said holding means are written into the memory and also supplied to said converting means for simultaneous display on the cathode ray tube.

* * * * *